US012214936B2

(12) United States Patent
Liao

(10) Patent No.: US 12,214,936 B2
(45) Date of Patent: Feb. 4, 2025

(54) FOOD CONTAINER STRUCTURE

(71) Applicant: FREE-FREE INDUSTRIAL CORP, Taipei (TW)

(72) Inventor: Chien-Hua Liao, Taipei (TW)

(73) Assignee: FREE-FREE INDUSTRIAL CORP, Taipei (TW)

( * ) Notice: Subject to any disclaimer, the term of this patent is extended or adjusted under 35 U.S.C. 154(b) by 31 days.

(21) Appl. No.: 18/211,234

(22) Filed: Jun. 16, 2023

(65) Prior Publication Data

US 2024/0343452 A1 Oct. 17, 2024

(30) Foreign Application Priority Data

Apr. 12, 2023 (TW) ..... 112203319

(51) Int. Cl.
*B65D 43/02* (2006.01)
*B65D 43/26* (2006.01)

(52) U.S. Cl.
CPC ..... *B65D 43/0212* (2013.01); *B65D 43/26* (2013.01); *B65D 43/267* (2013.01); *B65D 2543/00194* (2013.01); *B65D 2543/00824* (2013.01); *B65D 2543/00842* (2013.01); *B65D 2543/00888* (2013.01)

(58) Field of Classification Search
CPC .. B65D 43/0212; B65D 43/26; B65D 43/267; B65D 2543/00194; B65D 2543/00824; B65D 2543/00842; B65D 2543/00888
USPC ..... 220/285, 326, 788
See application file for complete search history.

(56) References Cited

U.S. PATENT DOCUMENTS 3,934,722 A * 1/1976 Goldberg ..... B65D 41/32 215/253
4,809,868 A * 3/1989 Pomroy ..... B65D 43/0218 220/793
5,322,178 A * 6/1994 Foos ..... B65D 43/162 220/756
5,695,087 A * 12/1997 Tutton ..... B65D 45/22 206/508

(Continued)

FOREIGN PATENT DOCUMENTS

CA 2795909 A1 10/2011
CN 201595324 U 10/2010

(Continued)

OTHER PUBLICATIONS

PCT search report dated Oct. 28, 2023 of the corresponding PCT patent application No. PCT/CN2023/089158.

*Primary Examiner* — James N Smalley
(74) *Attorney, Agent, or Firm* — Chun-Ming Shih; HDLS IPR SERVICES

(57) ABSTRACT

A food container includes a box, a cover and a pair of locking wings. The box includes a main body and elastic engaging plates. The main body has a receiving space. The elastic engaging plates are arranged on opposite sides of the receiving space. Each elastic engaging plate includes an elastic arm and a clip. The cover includes a cover plate and engaging slots. The cover is positioned on the main body through the clip inserted in the engaging slot. The locking wings are pivotally coupled to the cover. Each locking wing rotates toward the box to press elastic arms. The elastic arms drive the clips to be disengaged from the engaging slots. Thus, the cover is separated from the box.

9 Claims, 10 Drawing Sheets

(56) References Cited

U.S. PATENT DOCUMENTS

| | | | | |
|---|---|---|---|---|
| 8,245,867 | B2 * | 8/2012 | Allen | B65D 51/20 220/326 |
| 8,870,021 | B2 * | 10/2014 | Smyers | A47G 19/02 220/795 |
| 2010/0012655 | A1 * | 1/2010 | Dathy | B44D 3/127 220/318 |
| 2013/0008905 | A1 | 1/2013 | Chang | |

FOREIGN PATENT DOCUMENTS

| | | | |
|---|---|---|---|
| CN | 107792522 | A | 3/2018 |
| JP | 2011189043 | A | 9/2011 |
| KR | 20120082532 | A | 7/2012 |
| WO | 2021075863 | A1 | 4/2021 |

* cited by examiner

FOOD CONTAINER STRUCTURE

BACKGROUND OF THE DISCLOSURE

Technical Field

This disclosure relates to a food container, and more particularly relates to a food container lock structure.

Description of Related Art

Using a food container in daily life is very convenient. Vegetables, fruit or dried fruits, nuts etc., reserved in the food containers may be isolated from the external environment to prolong the storage time. Additionally, food containers may be stacked on each other to facilitate storage.

Moreover, a food container is usually composed of a box and a cover fastened to the box. The fastening method of the box and the cover is achieved by disposing locking wings on two sides of the cover and outer flaps disposed on the top edge of the box. Accordingly, the locking wings of the cover may be engaged with the outer flaps of the box to achieve a tight locking therebetween. However, although the above-mentioned fastening method may achieve a tight locking between the box and the cover, users need to pull the edges of the locking wings with both hands to make the cover disengage from the box first, and then the cover needs to be taken away from the box manually. Thus, it is inconvenient to use.

In view of the above drawbacks, the inventor proposes this disclosure based on his expert knowledge and elaborate researches in order to solve the problems of related art.

SUMMARY OF THE DISCLOSURE

One object of this disclosure is to provide a food container structure, in which the cover is separated from the box by rotating the pair of locking wings to be disengaged from the engaging slot for improving the convenience of use.

This disclosure is a food container structure including a box, a cover and a pair of locking wings. The box includes a main body and at least one pair of elastic engaging plate groups. The main body has a receiving space. The pair of elastic engaging plate groups are arranged on two sides of the receiving space opposite to each other, each elastic engaging plate group comprises at least one elastic engaging plate, and the elastic engaging plate includes an elastic arm and a clip. The cover is removably fastened to the box and covers the receiving space. The cover includes a cover plate and at least one pair of engaging slot groups arranged on two sides of the cover plate opposite to each other. Each engaging slot group includes an engaging slot. The cover is positioned on the main body through the clip of each of the elastic engaging plates being inserted in the engaging slot. The pair of locking wings are pivotally coupled to two sides of the cover plate opposite to each other. Each locking wing is disposed corresponding to each elastic engaging plate, and includes at least one protrusion disposed on a side thereof facing the cover and protrudes from a side of the elastic arm. Each locking wing is configured to rotate toward the box to make the at least one protrusion press each elastic arm. The elastic arm is configured to drive the clip to be disengaged from the engaging slot to separate the cover from the box.

In comparison with the related art, the food container structure in this disclosure includes elastic engaging plates disposed on the box, engaging slots disposed on two sides of the cover opposite to each other, and the locking wings provided with protrusions and hooks pivotally coupled to two sides of the cover plate. Accordingly, the locking wings are pulled to rotate toward the box, and the hooks of the locking wings may be disengaged from the bottom side of each engaging slot. Therefore, the protrusion of each locking wing may press the elastic arm of each elastic engaging plate and drive the clip to be disengaged from the engaging slot. Therefore, users may pull the locking wings to separate the cover from the box for increasing the convenience of use.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
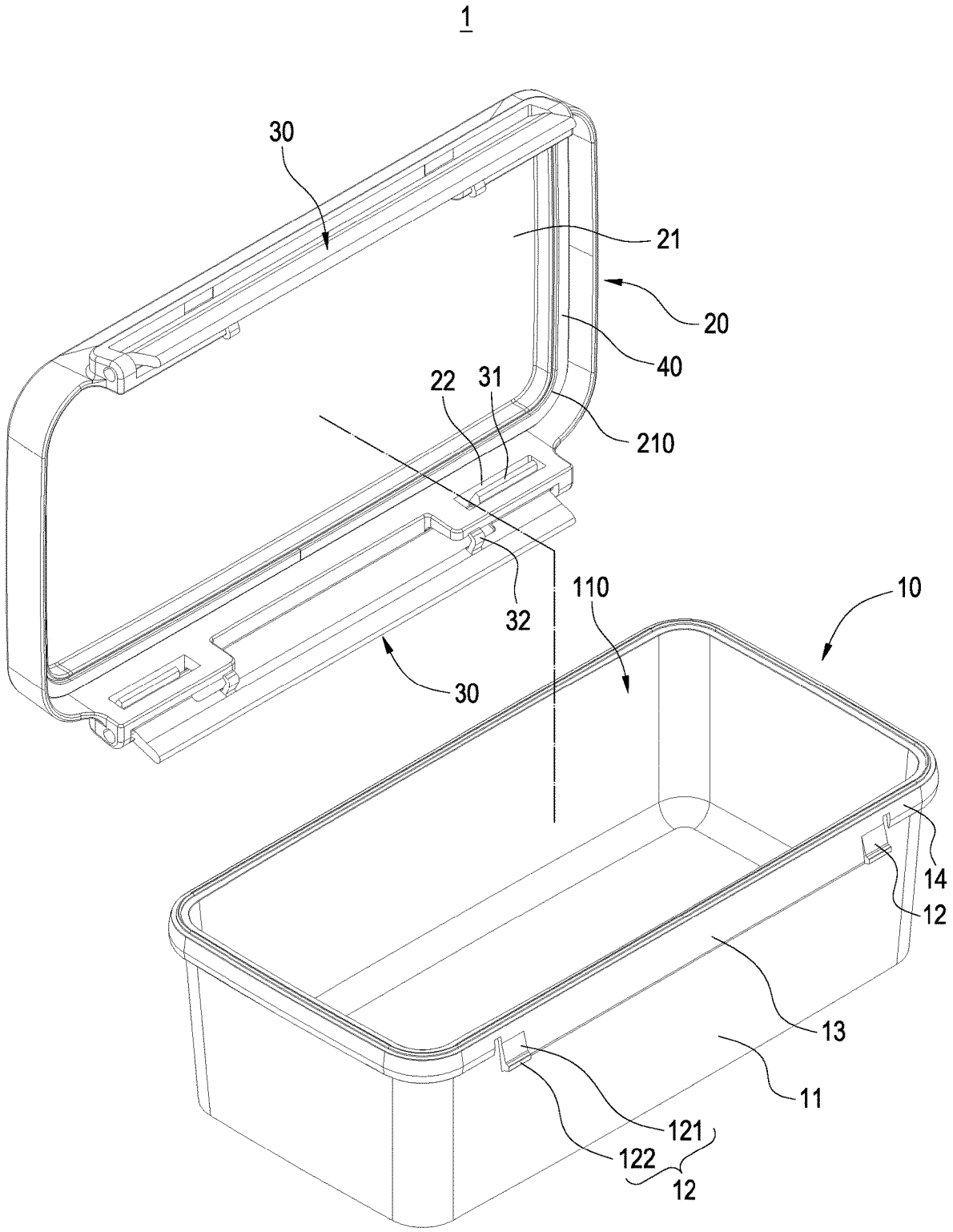
FIG. 1 is a perspective exploded schematic view of the food container structure in this disclosure.
Figure 2:
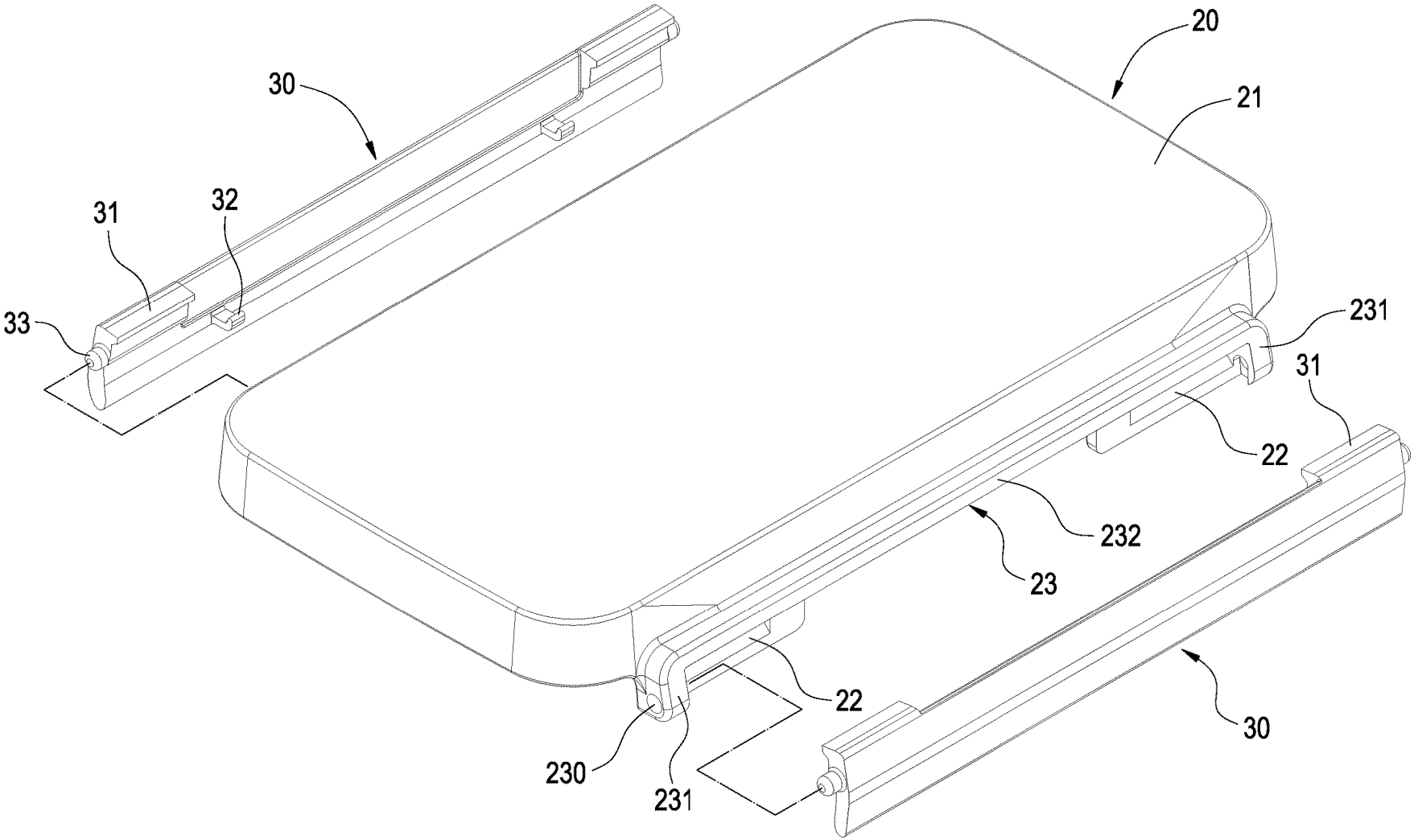
FIG. 2 is a perspective exploded schematic view of the cover of the food container structure in this disclosure.

Please refer to FIG. 1 and FIG. 2, which are a perspective exploded schematic view of the food container structure in this disclosure and a perspective exploded schematic view of the cover of the food container structure in this disclosure. This disclosure provides a food container structure 1 including a box 10, a cover 20 and a pair of locking wings 30. The pair of locking wings 30 are pivotally coupled to two sides of the cover 20 opposite to each other. The cover 20 is removably fastened to the box 10 by engaging the pair of locking wings 30.

The box 10 is, but not limited to, a cuboid. The box 10 includes a main body 11 and at least one pair of elastic engaging plates 12 (or at least one pair of elastic engaging plate groups, each elastic engaging plate group has at least one elastic engaging plate 12). Moreover, the main body 11 has a receiving space 110. The pair of elastic engaging plates 12 are arranged on two sides of the receiving space 110 opposite to each other, and each of the elastic engaging plates 12 includes an elastic arm 121 and a clip 122.

The cover 20 is removably fastened to the box 10 to cover the receiving space 110. The cover 20 includes a cover plate 21 and at least one pair of engaging slots 22 (or at least one pair of engaging slot groups, each engaging slot group has at least one engaging slot 22) arranged on two sides of the cover plate 21 opposite to each other. The number of the engaging slots 22 is corresponding to the number of the elastic engaging plates 12. The cover 20 is positioned on the main body 11 through the clip 122 of each elastic engaging plate 12 being inserted in each engaging slot 22.

In this embodiment, two elastic engaging plates 12 are arranged on each side of the receiving space 110. Additionally, two engaging slots 22 are arranged on each side of the cover plate 21.

Furthermore, in order to make each elastic engaging plate 12 on a single side has better strength of structures, the box 10 further includes an extension plate 13. The extension plate 13 is connected to each elastic engaging plate 12 on a single side of the main body 11.

Moreover, the pair of locking wings 30 are pivotally coupled to two sides of the cover plate 21 opposite to each other. Each locking wing 30 is disposed corresponding to each elastic engaging plate 12, and the protrusion 31 and the hook 32 are located on the side surface facing the cover 20 corresponding to the number and position of the engaging slots 22. In this embodiment, the protrusion 31 and the hook 32 are integrally formed (or formed in one piece) with each of the locking wings 30.

It is worth noticing that the cover plate 21 includes a pair of flanges 23. Each flange 23 protrudes from one side of each engaging slot 22 and covers a side of each locking wing 30. Additionally, each of the flanges 23 is arranged in a U shape and includes two side walls 231 and a top wall 232 connected to the two side walls 231. A pivot hole 230 is disposed on each side wall 231. On the other hand, two ends of each of the locking wings 30 is provided with a pivot shaft 33 respectively. Accordingly, each of the locking wings 30 is coupled to the cover plate 21 through the pivot shaft 33 being inserted to the pivot hole 230.

Figure 3:
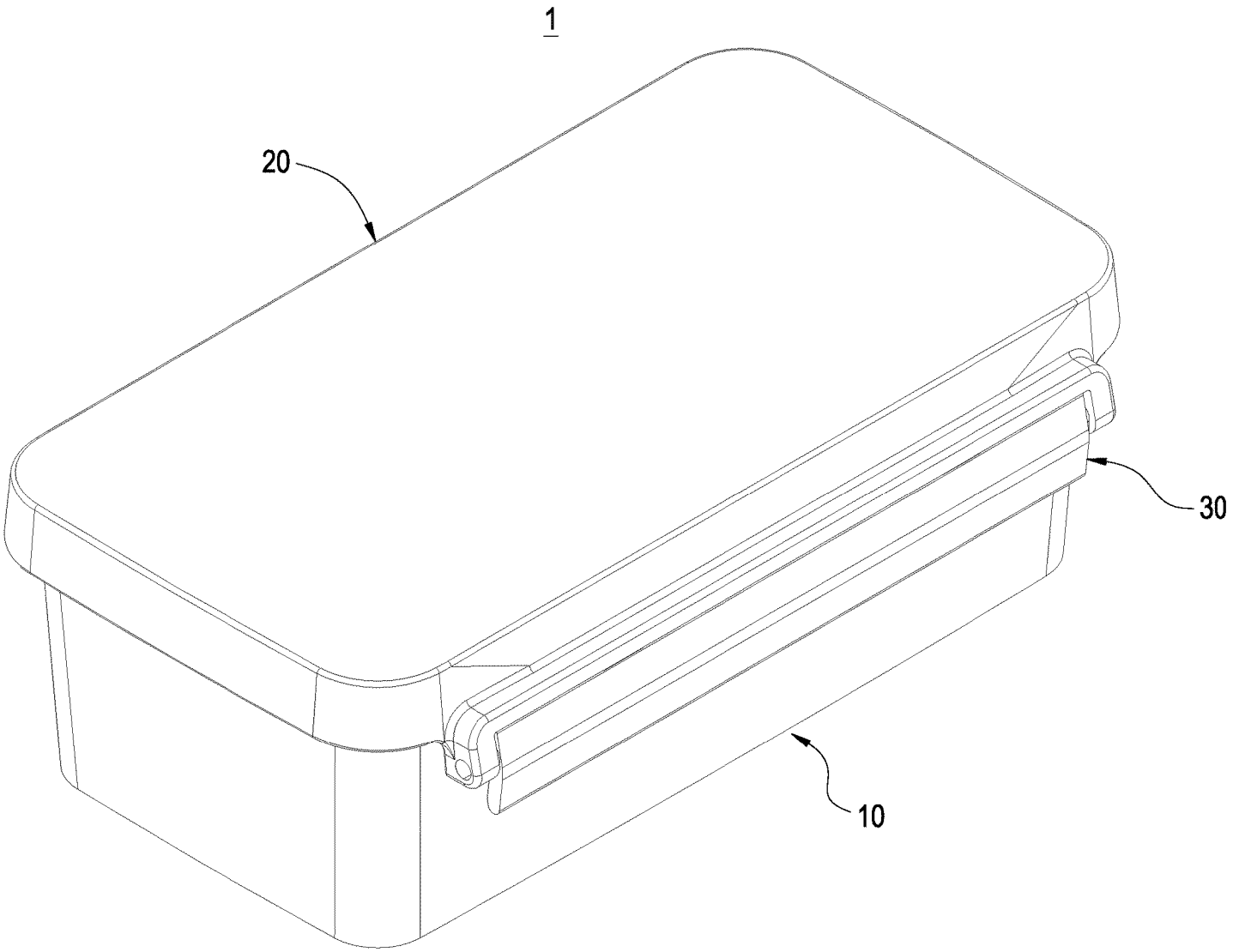
FIG. 3 is a perspective schematic view of the food container in this disclosure.
Figure 4:
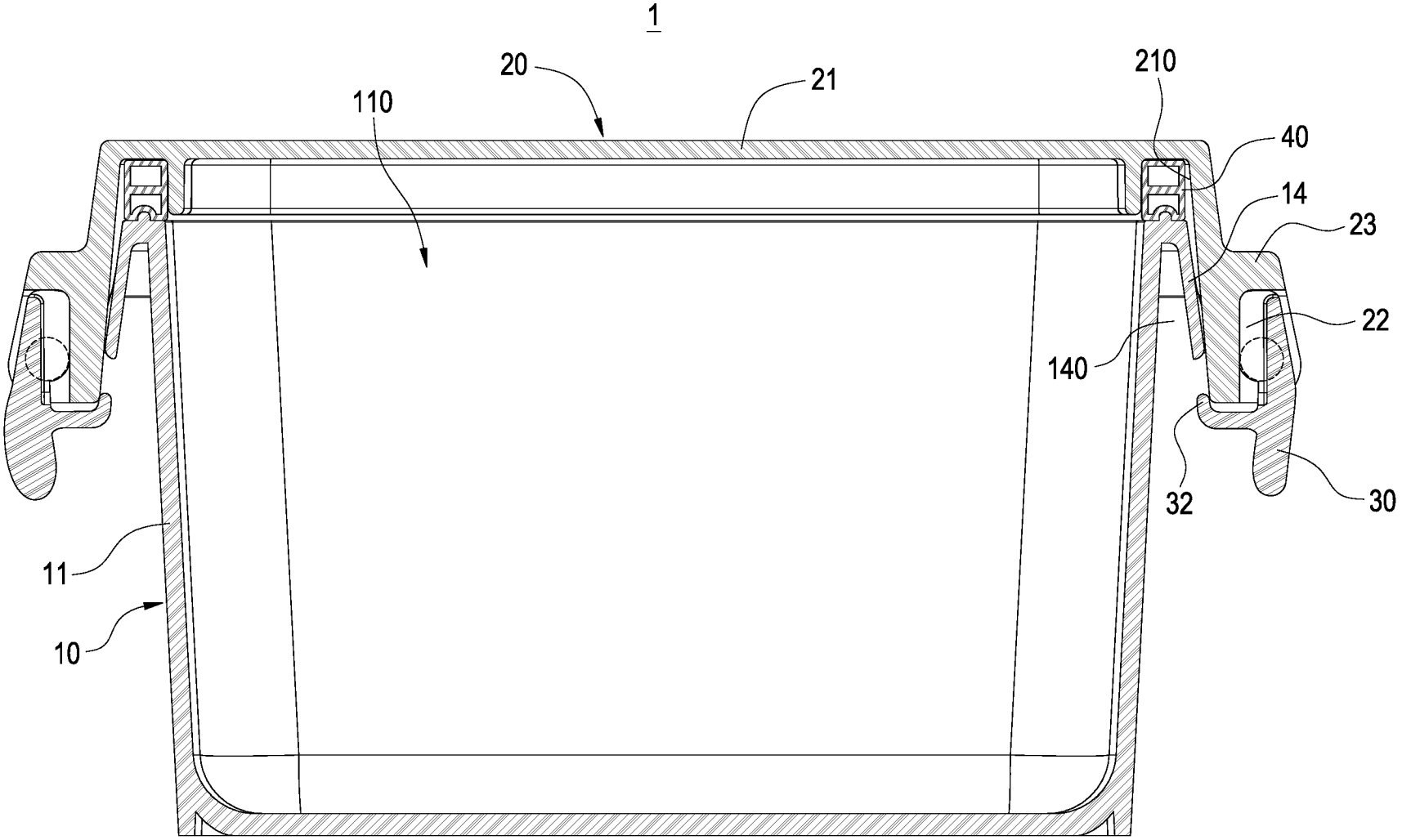
FIG. 4 is a cross-sectional view at the hook of the locking wing of the food container structure in this disclosure.
Figure 5:
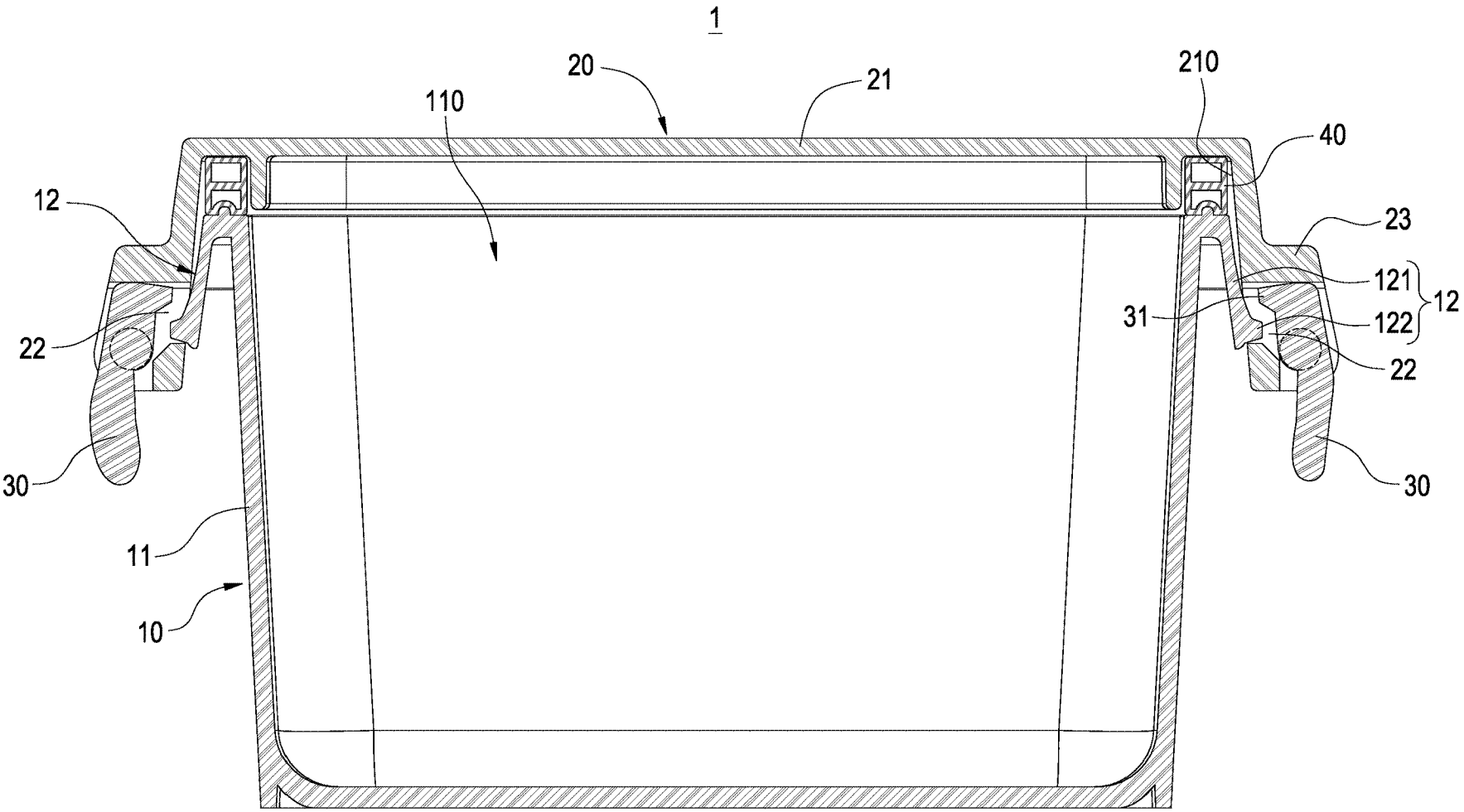
FIG. 5 is a cross-sectional view at the protrusion of the locking wing of the food container structure in this disclosure.

With further reference to FIG. 3 to FIG. 5, which are a perspective schematic view of the food container in this disclosure, a cross-sectional view at the hook of the locking wing of the food container structure in this disclosure and a cross-sectional view at the protrusion of the locking wing of the food container structure in this disclosure. As shown in FIG. 4, in this embodiment, the box 10 further includes a turning flap 14. The turning flap 14 is bent and extended from the top edge of the main body 11 to form a buffer space 140 with respect to the outer surface of the main body 11. The turning flap 14 is connected to the pair of elastic engaging plates 12 (or at least one pair of elastic engaging plate groups, each elastic engaging plate group has at least one elastic engaging plate 12) in one-piece form.

Please refer to FIG. 1 and FIG. 2, when the box 10 is combined with the cover 20, the protrusions 32 of each locking wing 30 protrude from one side of the elastic arm 121 of each elastic engaging plate 12, and the hooks 32 of each locking wing 30 may abut against the bottom side of each engaging slot 22 (as shown in FIG. 4). In the embodiment, the protrusion 32 is inserted in each engaging slot 22 and stopped above the clip 122 of the elastic engaging plate 12.

Furthermore, the food container structure 1 further includes a sealing strip 40 sandwiched between the main body 11 and the cover plate 21. Specifically, an annular groove 210 is disposed on an inner wall of the cover plate 21. The sealing strip 40 is arranged in the annular groove 210. As shown in FIG. 5, when the cover 20 covers the main body 11, the clip 122 of each elastic engaging plate 12 may snap into each engaging slot 22 to press the edge of the engaging slot 22. Therefore, the cover 20 is positioned on the box 10, and the airtightness therebetween is maintained through the sealing strip 40.

Figure 6:
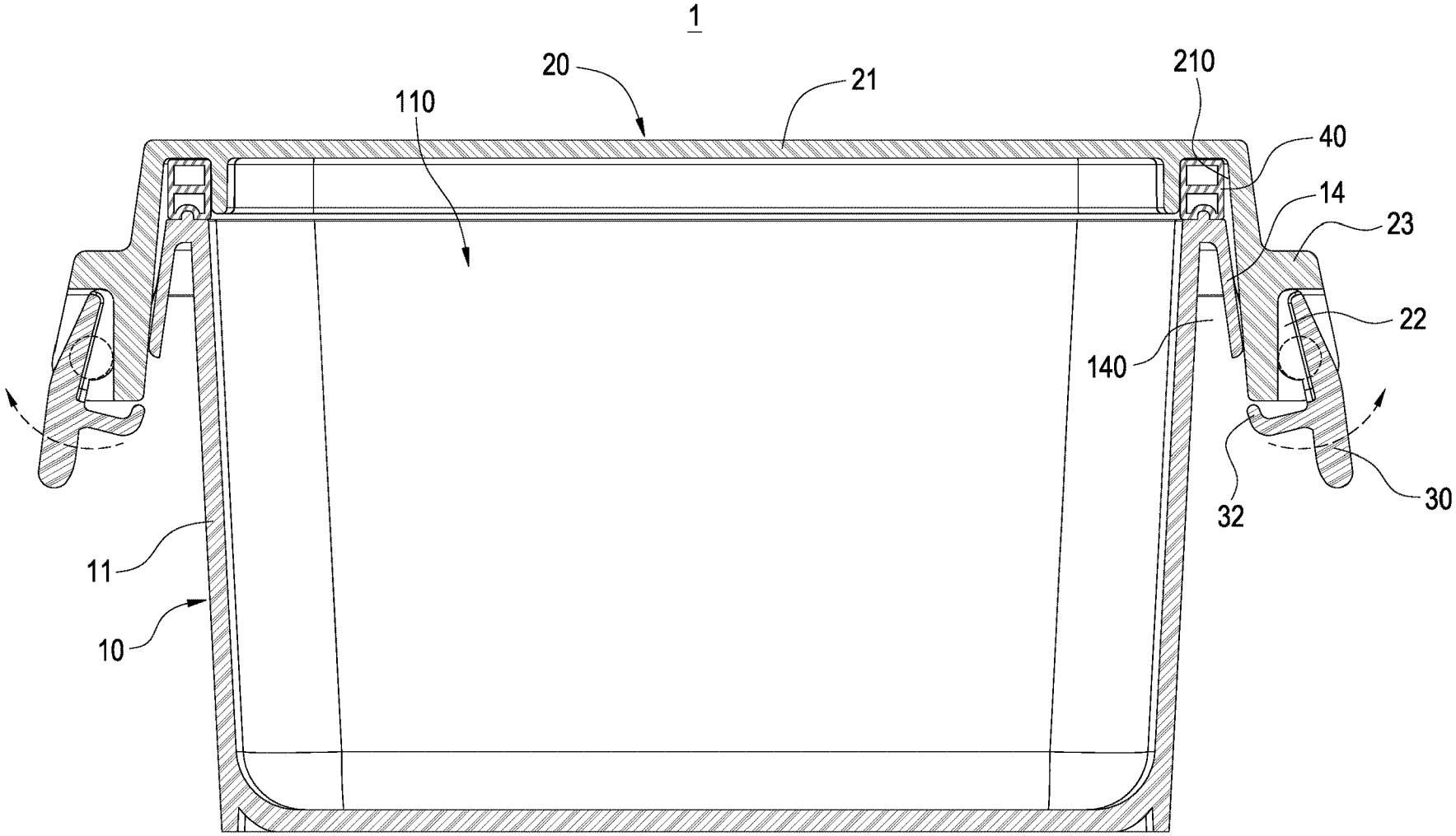
FIG. 6 to FIG. 9 are operation schematic views of the food container structure in this disclosure.
Figure 7:
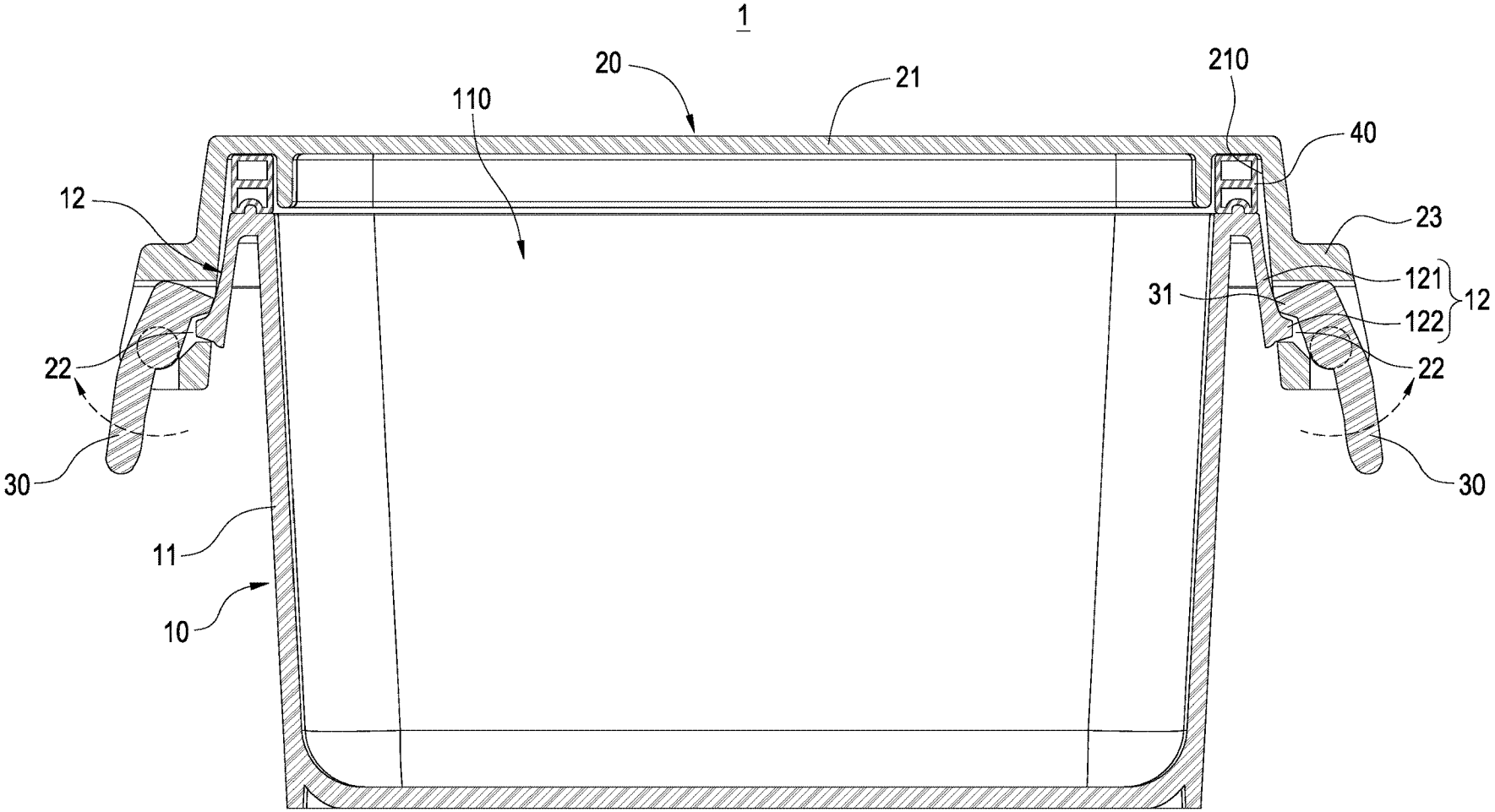
Figure 8:
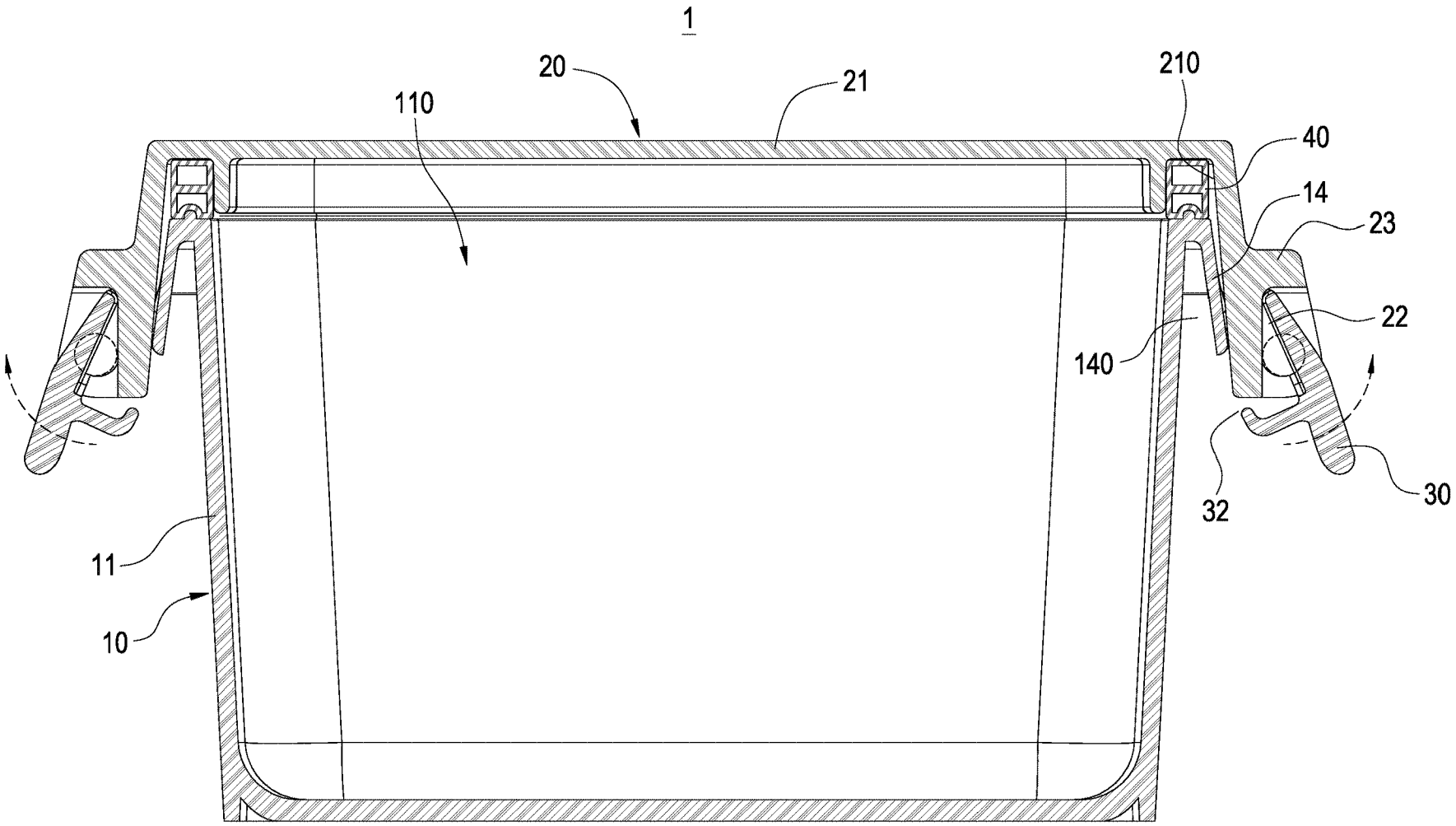
Figure 9:
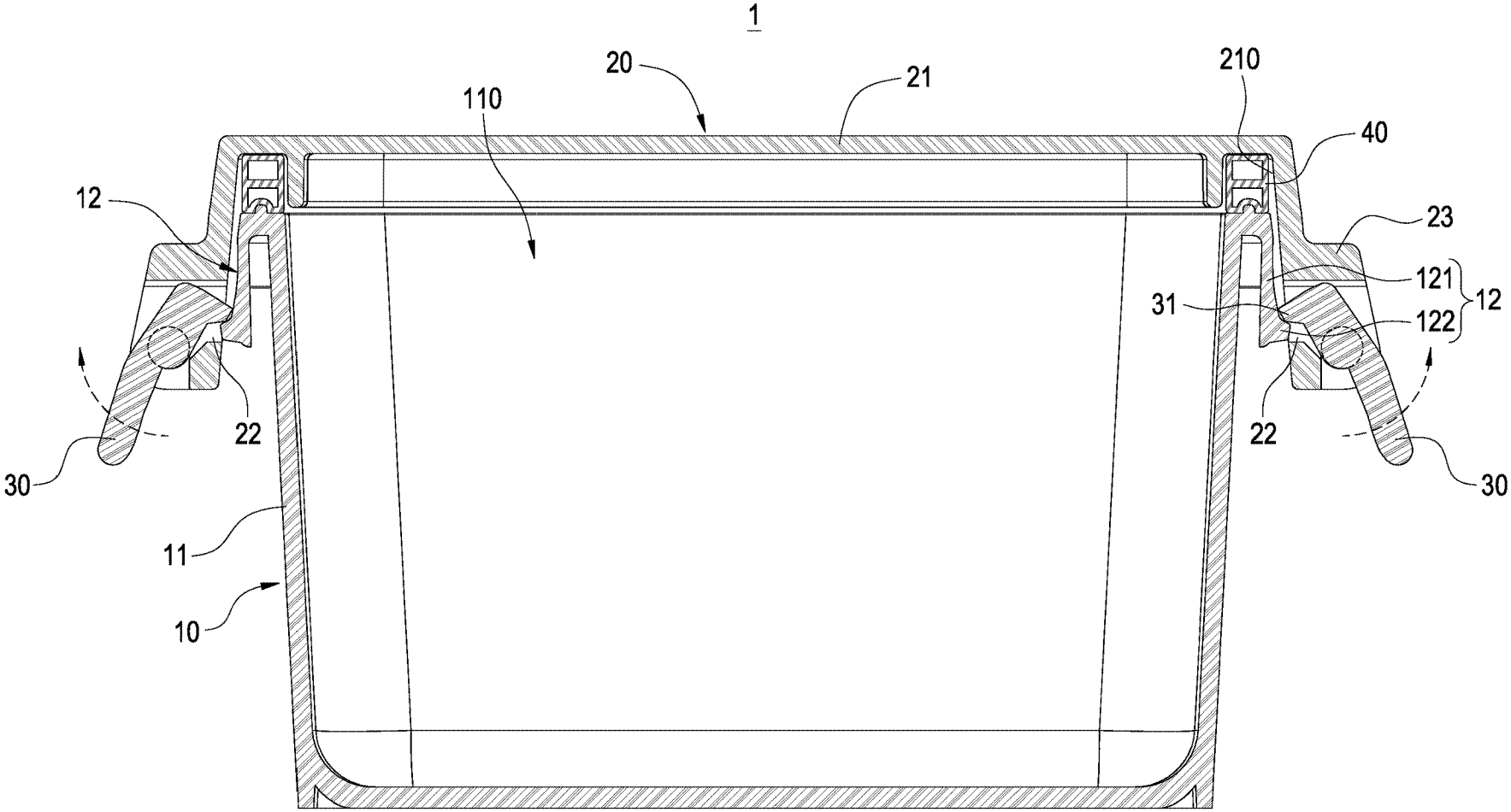

Please further refer to FIG. 6 to FIG. 9, which are operation schematic views of the food container structure in this disclosure. Users open the food container structure 1 by applying an external force to pull the lower edges of the pair of locking wings 30. Thus, the upper edges of the pair of locking wings 30 rotates toward the main body 11. Then, the hooks 32 of the locking wings 30 may be disengaged from the bottom side of each engaging slot 22 (as shown in FIG. 6 and FIG. 8). The protrusion 31 of each locking wing 30 may press the elastic arms 121 of each elastic engaging plate 12 (as shown in FIG. 7). Thus, the elastic arm 121 drives the clip 122 to be disengaged from the engaging slot 22 (as shown in FIG. 9).

Figure 10:
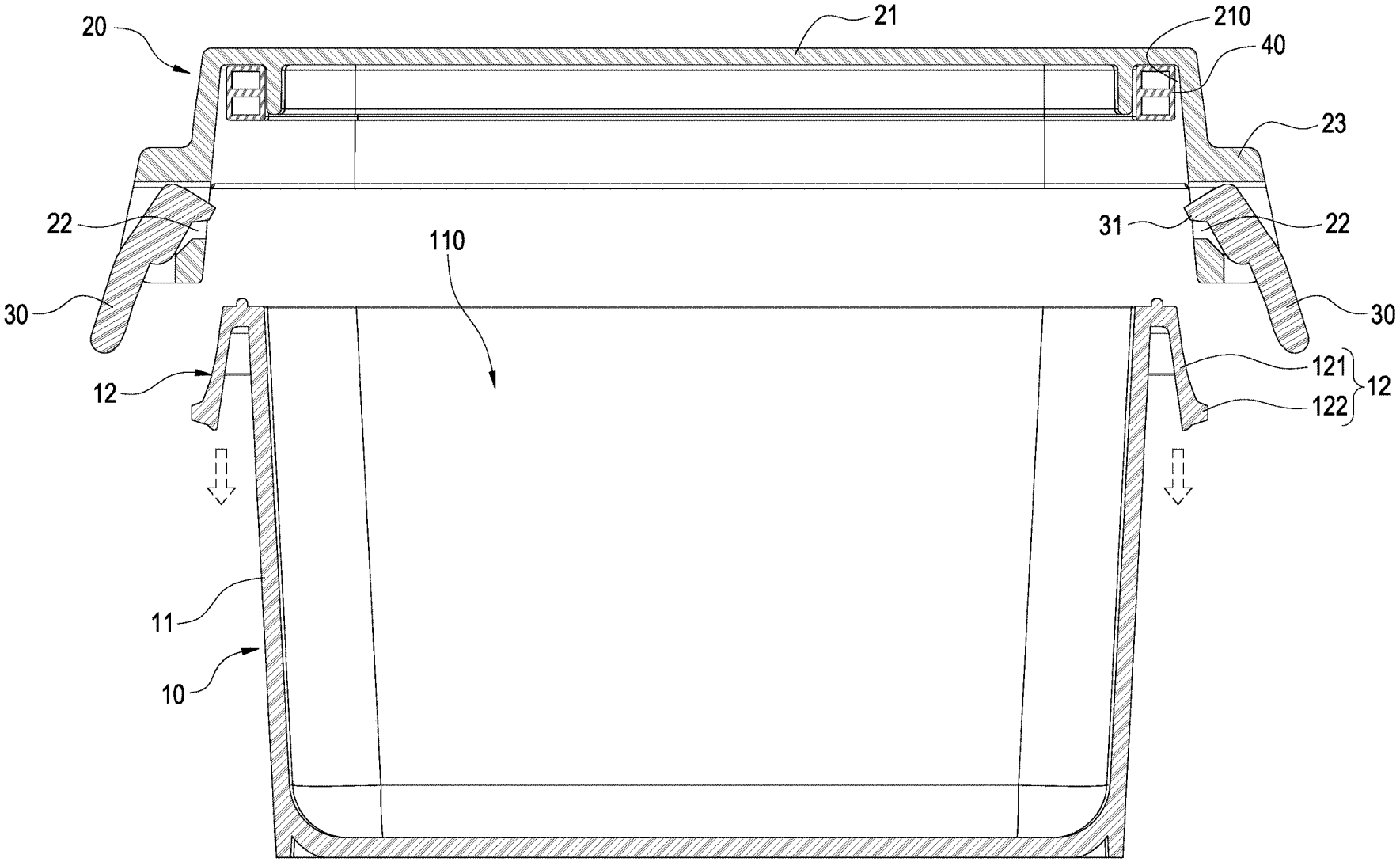
FIG. 10 is a separation schematic view of the box and the cover of the food container in this disclosure.

Please refer to FIG. 10, which is a separation schematic view of the box and the cover of the food container in this disclosure. Therefore, the elastic arm 121 drives the clip 122 to be disengaged from the engaging slot 22, and the cover 20 may be separated from the body 10. It should be noted that when the box 10 is hanged in the air, the box 10 may be separated from the cover 20 on its own weight through the above-mentioned operation.

While this disclosure has been described by means of specific embodiments, numerous modifications and variations could be made thereto by those skilled in the art without departing from the scope and spirit of this disclosure set forth in the claims.

What is claimed is:

1. A food container structure, comprising:

a box, comprising a main body and two pairs of elastic engaging plate groups, the main body comprising a receiving space, wherein the two pairs of elastic engaging plate groups are arranged on two sides of the main body opposite to each other, respectively, each elastic engaging plate group comprises at least one elastic engaging plate, and the elastic engaging plate comprises an elastic arm and a clip;

a cover, removably fastened to the box and covering the receiving space, comprising a cover plate and two pairs of engaging slot groups arranged on two sides of the cover plate opposite to each other, respectively, wherein each engaging slot group comprises an engaging slot, the cover is positioned on the main body through the clip of the elastic engaging plate being inserted in the engaging slot; and a pair of locking wings, pivotally coupled to two sides of the cover plate opposite to each other, respectively, wherein each locking wing is disposed corresponding to the elastic engaging plate, and comprises two protrusions disposed on a side thereof facing the cover and protruding from a side of the elastic arm;

wherein each locking wing is configured to rotate toward the box to make the two protrusions press each elastic arm, and the elastic arm is configured to drive the clip to be disengaged from the engaging slot to separate the cover from the box.

2. The food container structure according to claim 1, wherein the box further comprises a turning flap bent and extended from a top edge of the main body to define a buffer space with respect to an outer surface of the main body.

3. The food container structure according to claim 2, wherein the turning flap is connected to the pair of elastic engaging plate groups.

4. The food container structure according to claim 1, wherein the box further comprises an extension plate connected to the elastic engaging plates on each side of the main body.

5. The food container structure according to claim 1, wherein the cover plate comprises a pair of flanges, and each flange protrudes from an outer surface of the cover plate and covers a side surface of each locking wing.

6. The food container structure according to claim 5, wherein each of the flanges is arranged in a U shape and comprises two side walls and a top wall connected to the two side walls, and a pivot hole is defined on each side wall; and each of the locking wings comprises a pivot shaft disposed on each end thereof respectively, and each of the locking wings is coupled to the cover plate through the pivot shaft being inserted to the pivot hole of each side wall.

7. The food container structure according to claim 1, wherein the at least one protrusion is inserted in the engaging slot and stopped above the clip.

8. The food container structure according to claim 1, further comprising a sealing strip sandwiched between the main body and the cover plate, wherein an annular groove is disposed on an inner wall of the cover plate, and the sealing strip is arranged in the annular groove.

9. The food container structure according to claim 1, wherein each of the locking wings comprises at least one hook disposed on a side thereof facing the cover, and the at least one hook abuts against a bottom side of the engaging slot.

* * * * *